US006056492A

United States Patent [19]

Hudson

[11] Patent Number: 6,056,492

[45] Date of Patent: May 2, 2000

[54] BOOK HAVING A REMOVABLE BOOKMARK AND METHOD OF MAKING A BOOK HAVING A REMOVABLE BOOKMARK

[75] Inventor: David William Hudson, Crawfordsville, Ind.

[73] Assignee: R.R. Donnelley & Sons Company, Chicago, Ill.

[21] Appl. No.: 09/159,802

[22] Filed: Sep. 23, 1998

[51] Int. Cl.[7] ..... B42B 43/00

[52] U.S. Cl. ..... 412/1; 40/124.1; 116/234; 116/239; 281/42; 412/4; 412/8

[58] Field of Search ..... 412/1, 4, 8, 19, 412/24; 281/37, 42, 19.1; 116/239, 234; 40/124.1

[56] References Cited

U.S. PATENT DOCUMENTS

| | | | |
|---|---|---|---|
| Re. 34,759 | 10/1994 | Boyette | 281/29 |
| 732,527 | 6/1903 | Devlin . | |
| 1,354,354 | 9/1920 | Toland . | |
| 1,397,605 | 11/1921 | Rhoads . | |
| 2,560,087 | 7/1951 | Cohn | 281/34 |
| 2,590,615 | 3/1952 | Heckerdorn | 116/234 |
| 2,935,337 | 5/1960 | Ecclestone | 281/34 |
| 3,297,341 | 1/1967 | Reed et al. | 281/34 |
| 3,933,375 | 1/1976 | Humphrey et al. | 281/34 |
| 3,981,522 | 9/1976 | Bloom | 281/34 |
| 4,209,187 | 6/1980 | Forrest | 281/19 |
| 4,341,401 | 7/1982 | Arntzen | 281/34 |
| 4,412,692 | 11/1983 | Williams | 281/34 |
| 4,765,652 | 8/1988 | Troyen | 281/42 |
| 5,028,193 | 7/1991 | Misicka | 412/8 |
| 5,359,793 | 11/1994 | Copperstone | 40/124.1 |
| 5,382,053 | 1/1995 | Tanka | 281/42 |
| 5,388,861 | 2/1995 | Reiter | 281/4 |
| 5,515,809 | 5/1996 | Weinberg | 116/235 |
| 5,713,606 | 2/1998 | Kleinberg et al. | 281/42 |

FOREIGN PATENT DOCUMENTS

| | | | |
|---|---|---|---|
| 441743 | 1/1936 | United Kingdom | 281/34 |
| 443483 | 2/1936 | United Kingdom | 281/34 |

*Primary Examiner*—Andrea L. Pitts
*Assistant Examiner*—Monica Smith
*Attorney, Agent, or Firm*—Marshall, O'Toole, Gerstein, Murray & Borun

[57] ABSTRACT

In order to provide a bookmark for a book, a method of making a book includes the step of applying a releasing adhesive to an inner surface of a front or rear cover having an initially greater width. The outer portion of this cover is then folded inwardly along a fold line so as to be in generally confronting relation with the inner surface of that cover to cause the width after folding to generally correspond to the width of the other cover. The outer portion of that cover is folded along the fold line so as to place the releasing adhesive in adhesive contact with confronting surfaces of both the folded outer portion and the remainder of that cover to adhesively secure them together after they have been folded into confronting relation. The cover is affixed to the body of a book and the book is trimmed inwardly of at least the fold line of that cover and inwardly of the foredge of the other cover to form a finished foredge for the book while at the same time severing the folded outer portion from the remainder of that cover. In this manner, the severed folded outer portion becomes an easily separable bookmark releasably secured by the releasing adhesive to the cover of the book.

18 Claims, 2 Drawing Sheets

BOOK HAVING A REMOVABLE BOOKMARK AND METHOD OF MAKING A BOOK HAVING A REMOVABLE BOOKMARK

FIELD OF THE INVENTION

The present invention generally relates to a method of making a book and, more particularly, a method of making a book having a removable bookmark.

BACKGROUND OF THE INVENTION

In recent years, there have been many developments of significance in the manner in which books are made. These developments have served to enhance the quality of books, the cost-effectiveness of the manufacture of books and the desirability of books to the reader. In fact, while bookmaking is a well known art, the progress that has been made in recent years has been noteworthy in many respects.

By way of example, Ecclestone U.S. Pat. No. 2,935,337 discloses an outer cover which included an inwardly folded flap that had a slit to form an integral bookmark. Much later, Troyen U.S. Pat. No. 4,765,652 discloses forming the flyleaf of a book with an inwardly folded portion that serves as a bookmark or, alternatively, adhesively securing the equivalent of the inwardly folded portion to the flyleaf of an existing book. In the Troyen '652 patent, the adhesive serves to permanently secure the equivalent of the inwardly folded portion to the flyleaf of books which are already in use.

As for other examples, Tanaka U.S. Pat. No. 5,382,053 discloses a bookmark and magnifying lens combination. One embodiment in the Tanaka '053 patent has a vertical perforation formed on an inwardly folded portion of a protective jacket which can subsequently be removed for the purpose of being used as a bookmark. In this manner, the Tanaka '053 patent is similar to Boyette U.S. Pat. No. Re. 34,759 which discloses a removable bookmarker strip.

More specifically, the Boyette '759 reissue patent claims a soft-back book having a protective cover which is formed of heavier material than the pages of the book. The protective cover overlies opposite sides of a plurality of pages and a spine edge, and it has perforations along a foredge marking a narrow strip which may be detached from the foredge and used as a bookmarker. In addition, the Boyette '759 patent claims a protective cover being folded along the perforations such that the narrow strip is interposed between the plurality of pages and the protective cover.

In yet another example of recent bookmaking developments, Reiter U.S. Pat. No. 5,388,861 discloses a transparent overlay for placement over printed material for the purpose of being able to make notations on the transparent overlay over the printed material without leaving permanent markings.

With regard to the attempts to provide a bookmarker, they have met with varying degrees of success. It is desirable for a book of any type, including a soft-back book, to have an integral bookmark when the book is sold. However, to be successful, a bookmark must be easily manufactured, remain associated with the book through sale, and be easily separated from the book for use by the reader.

In one or more respects, the earlier attempts discussed above have failed to meet these criteria in their entirety. As a result, the present invention is directed to overcoming this failure and achieving one or more of the resulting objects.

SUMMARY OF THE INVENTION

It is therefore a principal object of the present invention to provide a method of making a book having a removable bookmark. It is a further object of the present invention to provide such a method in which the removable bookmark is easily manufactured and remains associated with the book through sale so that it will be available to the reader. It is an additional object of the present invention to provide such a method wherein a bookmark is easily removable for use by the reader.

Accordingly, the present invention is directed to a method of making a book having a bookmark comprising the step of gathering a plurality of signatures on a collating conveyor in a predetermined order to thereby form a body of the book. The method also includes the step of providing a cover for the book including a front cover and a rear cover wherein one of the front and rear covers has a width when measured from a backbone edge generally intermediate of and integral with the front and rear covers to a foredge of one of the front and rear covers opposite the backbone edge which is initially greater than the corresponding width of the other of the front and rear covers. The method further includes the step of applying a releasing adhesive to an inner surface of the one of the front and rear covers having the initially greater width. The method still additionally includes the step of folding an outer portion of the one of the front and rear covers having the initially greater width inwardly toward the backbone edge along a fold line so as to be in generally confronting relation with the inner surface of at least a portion of the remainder of the one of the front and rear covers to thereby cause the width after folding to generally correspond to the width of the other of the front and rear covers. Subsequently, the method includes the step of affixing the cover to the body of the book with the backbone edge of the cover in confronting relation to backbone edges of the signatures forming the book body.

With this general arrangement of steps, the method further contemplates the outer portion of the one of the front and rear covers having the initially greater width being folded along the fold line so as to place the releasing adhesive in adhesive contact with confronting surfaces of both the folded outer portion and the remainder of the one of the front and rear covers to adhesively secure them together after they have been folded into confronting relation. It will be understood that this preferably occurs prior to affixing the cover to the body of the book with the backbone edge of the cover in confronting relation to backbone edges of the signatures forming the book body. After the step of affixing the cover, the method includes the step of trimming the book inwardly of at least the fold line of the one of the front and rear covers having the initially greater width and inwardly of the foredge of the other of the front and rear covers so as to form a finished foredge for the book while at the same time severing the folded outer portion from the remainder of the one of the front and rear covers having the initially greater width.

By performing the method as described, the severed folded outer portion becomes an easily separable bookmark releasably secured by the releasing adhesive to the cover of the book.

In still other respects, the method contemplates the signatures each having an initial width when measured from the backbone edge to a foredge thereof which is less than the corresponding width of the one of the front and rear covers having the initially greater width prior to the step of folding the outer portion thereof. As so configured, the trimming step preferably includes trimming the signatures inwardly of the foredges while also trimming the front and rear covers to form the finished foredge of the book such that the front and rear covers and the signatures are all of uniform width when measured from the backbone edges to the foredges thereof.

In still additional respects, the method contemplates the cover for the book being a soft cover that has the backbone edge secured to the backbone edges of the signatures by one of sewing, adhesive binding, saddlestich binding or mechanical binding wherein the cover for the book is rendered integral with the signatures forming the body of the book. When so formed, the front and rear covers for the book are also advantageously generally rectangular, the signatures forming the book body are also advantageously generally rectangular, and the bookmark formed during trimming when the folded outer portion of the one of the front and rear covers is severed is also advantageously generally rectangular.

As for still other details, the one of the front and rear covers having the initially greater width preferably comprises the rear cover of the book and the severed folded outer portion comprising the bookmark is preferably releasably secured in confronting relation to the inner surface of the rear cover by the releasing adhesive. It is highly advantageous for the releasing adhesive to comprise a fugitive glue that releasably secures the bookmark to the cover of the book and is later easily removed from the bookmark and/or the inner surface of the rear cover of the book after the bookmark has been removed from the rear cover of the book for use thereof. In still another respect, the severed folded outer portion of the one of the front and rear covers having the initially greater width is preferably less than one-half the width of the remainder of the one of the front and rear covers after the book has been trimmed inwardly of the fold line and of the foredge of the other of the front and rear covers.

In another respect, the present invention is directed to a book having a bookmark wherein the book comprises a body formed of a plurality of signatures assembled in a predetermined order and a cover fixed to the body of the book to define a front cover, a rear cover, and a backbone edge intermediate of and integral with the front cover and the rear cover. The front cover and the rear cover each have a foredge opposite the backbone edge of the cover comprising the finished free edges of the cover of the book. A bookmark is provided having a width less than one-half of the width of the cover when measured from the backbone edge to the foredges of the front and rear covers. The bookmark is formed of the same material as the cover and is releasably secured to an inner surface of one of the front and rear covers. Additionally, the bookmark has a finished free edge generally coincident with the finished free edge of the corresponding one of the front and rear covers, and a releasing adhesive is provided between the inner surface of the corresponding one of the front and rear covers and a confronting surface of the bookmark to releasably secure the bookmark thereto.

With regard to the book, the bookmark is preferably releasably secured in confronting relation to the inner surface of the rear cover by the releasing adhesive which is advantageously fugitive glue. The book is advantageously such that the bookmark is formed by applying the fugitive glue to the inner surface of the rear cover. An outer portion of the rear cover is folded inwardly about a fold line to bring the folded outer portion into contact with the fugitive glue, and the folded outer portion and rear cover are trimmed inwardly of the fold line.

Other objects, advantages and features of the present invention will become apparent from a consideration of the following specification taken in conjunction with the accompanying drawings.

DETAILED DESCRIPTION OF THE PREFERRED EMBODIMENT

Figures 1, 2A, 2B, 2C:
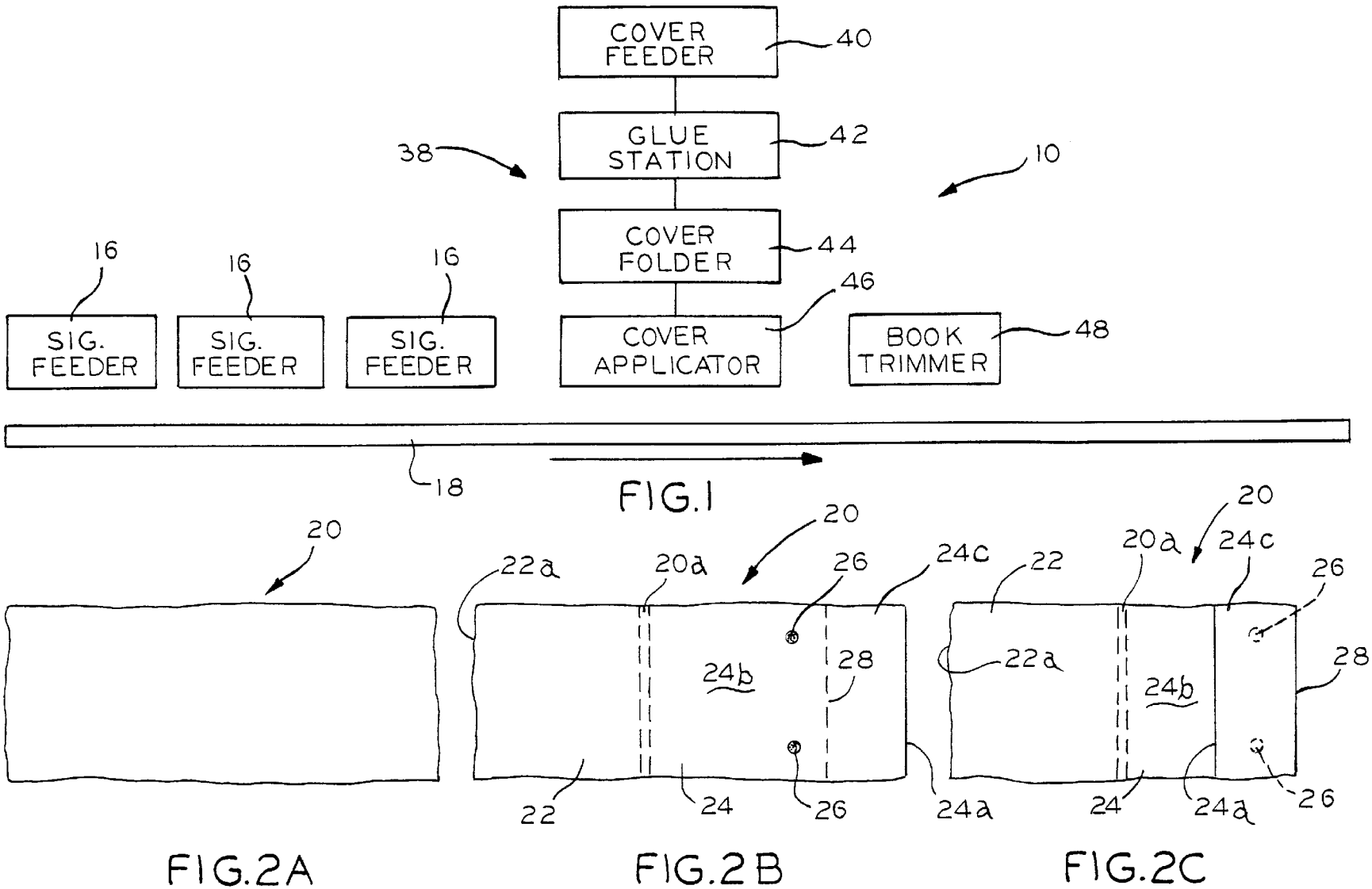
FIG. 1 is a schematic diagram showing the method of making a book having a bookmark in accordance with the present invention.
FIG. 2A is a plan view of a blank cover prior to any processing including the application of a releasing adhesive.
FIG. 2B is a plan view of a cover following application of a releasing adhesive and showing outer portion and backbone edge fold lines.
FIG. 2C is a plan view of a cover following the folding of an outer portion and showing backbone edge fold lines.

In the illustrations given, and with reference first to FIG. 1, the reference numeral 10 designates generally a method of making a book 12 (see FIG. 5) having a bookmark 14 which includes the step of gathering a plurality of signatures from signature feeders 16 on a collating conveyor 18 in a predetermined order to thereby form the body of the book 12. The method 10 also includes the step of providing a book cover 20 (see FIG. 3) for the book 12 including a front cover 22 and a rear cover 24. One of the front and rear covers (such as the rear cover 24) has a width when measured from a backbone edge 20*a* of the book cover 20 generally intermediate and integral with the front and rear covers 22 and 24 to an initial foredge 24*a* of the rear cover 24 opposite the backbone edge 20*a* of the book cover 20 which is initially greater than the corresponding width of the other of the covers, i.e., front cover 22 (see FIG. 2B). The method 10 further includes the step of applying a release adhesive as at 26 to an inner surface 24*b* of the rear cover 24 having the initially greater width. Further, the method 10 includes the step of folding an outer portion 24*c* of the rear cover 24 having the initially greater width inwardly toward the backbone edge 20*a* of the book cover 20 along a fold line 28.

Figure 3:
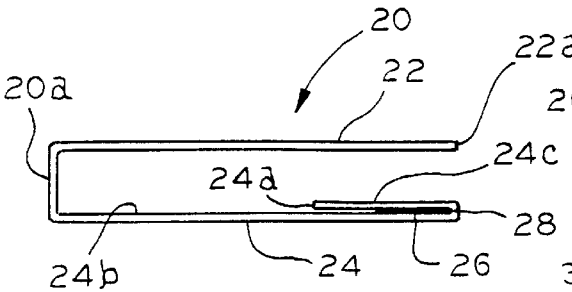
FIG. 3 is a cross-sectional view taken generally along the line 3—3 of FIG. 2D.

After this folding step, the outer portion 24*c* is in generally confronting relation with the inner surface 24*b* of at least a portion of the remainder of the rear cover 24 to thereby cause the width after folding to generally correspond to the width of the front cover 22 (see FIG. 2C). When configured as shown in FIG. 3, the book cover 20 is affixed to the body of the book 12 with the backbone edge 20*a* of the book cover 20 in confronting relation to backbone edges 32 of the signatures 34 forming the body of the book 12 (see in particular the finished book 12 in FIG. 4).

Figure 2D:
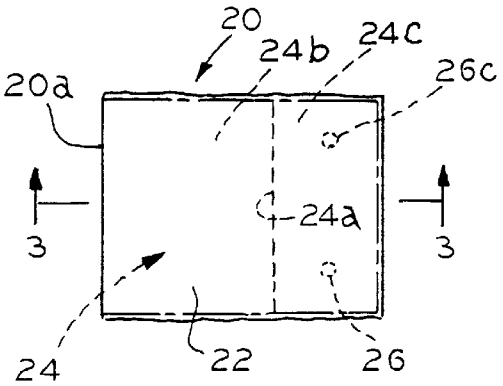
FIG. 2D is a plan view of a cover following the folding on the backbone edge fold lines.

With this arrangement, the outer portion 24*c* of the rear cover 24 having the initially greater width is folded along the fold line 28 so as to place the releasing adhesive 26 in adhesive contact with confronting surfaces of both the folded outer portion 24*c* and the remainder of the rear cover 24 to adhesively secure them together after they have been folded into confronting relation (see FIG. 2C). It will be appreciated that the book cover 20 is thereafter folded to form the backbone edge 20*a* prior to or simultaneously with affixing the book cover 20 to the body of the book 12 (see FIGS. 2D, 3 and 4). After this has occurred, the book 12 is trimmed at a point inwardly of at least the fold line 28 of the rear cover 24 and at a point inwardly of the foredge 22*a* of the front cover 22 so as to form a finished foredge 36 for the book 12 while at the same time severing the folded outer portion 24*c* from the remainder of the rear cover 24, i.e., severing the fold line 28.

In the foregoing manner, the now severed folded outer portion 24*c* becomes an easily separable bookmark 14 which is releasably secured by the releasing adhesive 26 to the book cover 20 of the book 12.

Figure 4:
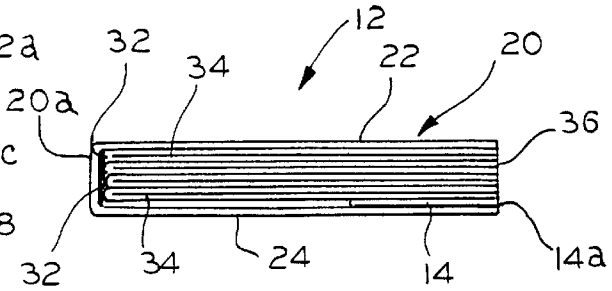
FIG. 4 is a bottom plan view after affixing the cover of FIG. 3 to a book and trimming the book.
Figure 5:
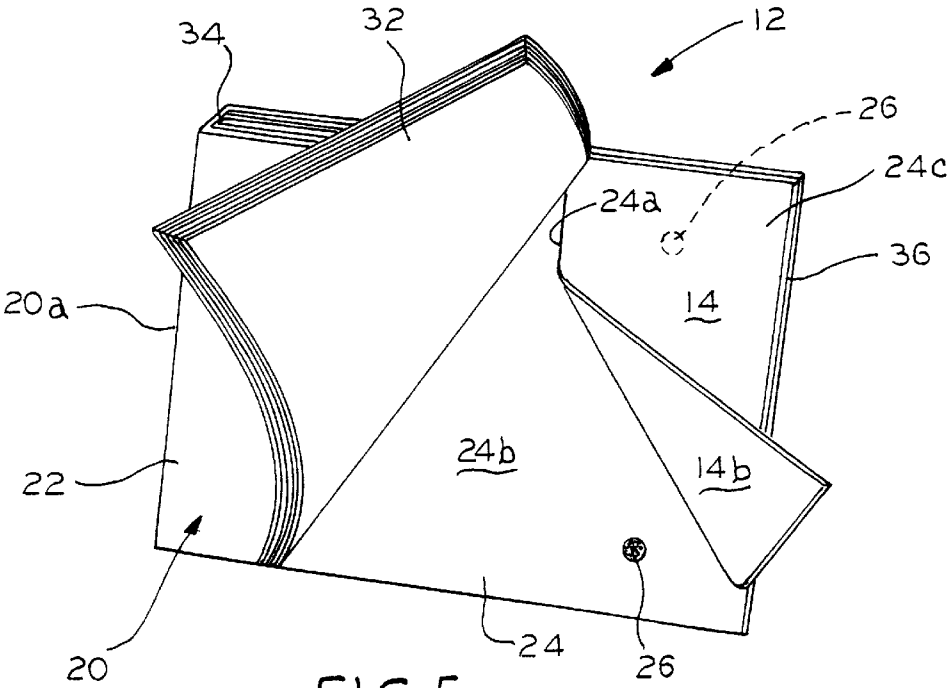
FIG. 5 is a perspective view showing the bookmark partially removed from the book.

As will be appreciated from FIGS. 4 and 5, the signatures 34 each have a width when measured from the backbone edge 32 to the finished foredge 36 of the book 12 which is initially less than the corresponding width of the rear cover 24 prior to the step of folding the outer portion 24*c* thereof. With this arrangement, the trimming step includes trimming the signatures 34 inwardly of the initial signature foredges, i.e., inwardly in a direction toward the backbone edges 32, while trimming the front and rear covers 22 and 24 inwardly of the initial foredge 22*a* of the front cover 22 and inwardly of the fold line 28 of the rear cover 24 to form the finished foredge 36 of the book 12. As a result, the front and rear covers 22 and 24 and the signatures 34 are all of uniform width when measured from the backbone edge 20*a* of the book cover 20 to the respective finished edges opposite thereof defining the finished foredge 36 of the book 12.

In the embodiment illustrated in FIGS. 4 and 5, the book cover 20 is a soft cover that has the backbone edge 20*a* secured to the backbone edges 32 of the signatures 34 by one of sewing, adhesive binding, saddlestich binding or mechanical binding wherein the book cover 20 is rendered integral with the signatures 34 forming the body of the book 12. As will also be appreciated from the illustrated embodiment, the front and rear covers 22 and 24 for the book 12 are generally rectangular, the signatures 34 forming the body of the book 12 are also generally rectangular, and the bookmark 14 formed during trimming when the folded outer portion 24*c* of the rear cover 24 is severed is also generally rectangular.

In the preferred embodiment, the severed folded outer portion 24*c* of the rear cover 24 is less than one-half the width of the remainder of the rear cover 24 after the book 12 has been trimmed inwardly of the fold line 28 and of the initial foredge 22*a* of the front cover 22.

Also, in the preferred embodiment, the releasing adhesive is fugitive glue that releasably secures the bookmark 14 to the book cover 20 and is easily removed from the bookmark 14 and/or the inner surface 24*b* of the rear cover 24 of the book 12 after the bookmark 14 has been removed from the book 12 for use thereof.

Referring to FIG. 1, the method can be clearly understood in relation to a standard binding line having a plurality of signature feeders 16 and a collating conveyor 18. It will be seen and appreciated from the schematic that the binding line will also include a cover delivery region generally designated 38 which will typically include a cover feeder 40, a glue station 42, a cover folder 44, and a cover applicator 46. After the book cover 20 has been applied to a book 12 by the cover applicator 46, the book 12 is transported by the collating conveyor 18 to a book trimmer 48 to complete the method in accordance with the present invention.

In another respect, and as will be appreciated from FIGS. 4 and 5, the present invention is directed to a book 12 having a bookmark 14 which includes a body formed of a plurality of signatures 34 in a predetermined order and a book cover 20 fixed to the body of the book 12 to define a front cover 22, a rear cover 24, and a backbone edge 20*a* intermediate of and integral with the front cover 22 and the rear cover 24. The front cover 22 and the rear cover 24 each have a foredge opposite the backbone edge 20*a* of the book cover 20 comprising finished free edges of the book cover 20. The finished free edges together with the free edges of the signatures 34 together define a finished foredge 36 of the book 12. The bookmark 14 has a width less than one-half of the width of the book cover 20 when measured from the backbone edge 20*a* to the finished foredge 36 of the book 12, i.e., when measured to the finished free edges of the front and rear covers 22 and 24. The bookmark 14 is formed of the same material as the book cover 20 and is releasably secured to an inner surface 24*b* of the rear cover 24. In this connection, the bookmark 14 has a finished free edge 14*a* generally coincident with the finished free edge of the rear cover 24, and a releasing adhesive 26 is provided between the inner surface 24*b* of the rear cover 24 and a confronting surface 14*b* of the bookmark 14.

As will be appreciated from the foregoing, the bookmark 14 is releasably secured in confronting relation to the inner surface 24*b* of the rear cover 24 by a releasing adhesive as at 26 which is advantageously fugitive glue. As will be appreciated from the description above, the bookmark 14 is formed by applying the fugitive glue to the inner surface 24*b* of the rear cover 24 and folding the outer portion 24*c* of the rear cover 24 inwardly about the fold line 28. After the outer portion 24*c* has been folded in this manner, it is brought into contact with the fugitive glue and the folded outer portion 24*c* and rear cover 24 are trimmed inwardly of the fold line 28.

In accordance with the invention, a unique and highly effective method of making a book having a bookmark has been provided. It will also be appreciated that the present invention successfully provides a unique book having a bookmark therein. By reason of the present invention, the reader of a book is assured of having a bookmark that is effective and has a highly desirable finished appearance.

While in the foregoing there has been set forth a preferred embodiment of the invention, it will be appreciated that the details herein given may be varied by those skilled in the art without departing from the true spirit and scope of the appended claims.

What is claimed is:

1. A method of making a book having a bookmark, comprising the steps of:

gathering a plurality of signatures on a collating conveyor in a predetermined order to thereby form a body of the book;

providing a cover for the book including a front cover and a rear cover wherein one of the front and rear covers has a width when measured from a backbone edge generally intermediate of and integral with the front and rear covers to a foredge of the one of the front and rear covers opposite the backbone edge which is initially greater than the corresponding width of the other of the front and rear covers;

applying a releasing adhesive to an inner surface of the one of the front and rear covers having the initially greater width;

folding an outer portion of the one of the front and rear covers having the initially greater width inwardly toward the backbone edge along a fold line so as to be in generally confronting relation with the inner surface of at least a portion of the remainder of the one of the front and rear covers to thereby cause the width after folding to generally correspond to the width of the other of the front and rear covers;

the outer portion of the one of the front and rear covers having the initially greater width being folded along the fold line so as to place the releasing adhesive in adhesive contact with confronting surfaces of both the folded outer portion and the remainder of the one of the front and rear covers to adhesively secure them together after they have been folded into confronting relation;

affixing the cover to the body of the book with the backbone edge of the cover in confronting relation to backbone edges of the signatures forming the body of the book; and trimming the book inwardly of at least the fold line of the one of the front and rear covers having the initially greater width and inwardly of the foredge of the other of the front and rear covers so as to form a finished foredge for the book while at the same time severing the folded outer portion from the remainder of the one of the front and rear covers having the initially greater width;

whereby the severed folded outer portion becomes an easily separable bookmark releasably secured by the releasing adhesive to the cover of the book.

2. The book making method of claim 1 wherein the signatures each have a width when measured from the backbone edge to a foredge which is initially less than the corresponding width of the one of the front and rear covers having the initially greater width prior to the step of folding the outer portion thereof.

3. The book making method of claim 2 wherein the trimming step includes trimming the signatures inwardly of the foredges while trimming the front and rear covers to form the finished foredge of the book such that the front and rear covers and the signatures are all of uniform width when measured from the backbone edges to the foredges thereof.

4. The book making method of claim 1 wherein the cover for the book is a soft cover that has the backbone edge secured to the backbone edges of the signatures by one of sewing, adhesive binding, saddlestich binding or mechanical binding wherein the cover for the book is rendered integral with the signatures forming the body of the book.

5. The book making method of claim 4 wherein the front and rear covers for the book are generally rectangular, the signatures forming the body of the book are also generally rectangular, and the bookmark formed during trimming when the folded outer portion of the one of the front and rear covers is severed is also generally rectangular.

6. A method of making a book having a bookmark, comprising the steps of:

gathering a plurality of signatures on a collating conveyor in a predetermined order to thereby form a body of the book;

providing a cover for the book including a front cover and a rear cover wherein one of the front and rear covers has a width when measured from a backbone edge generally intermediate of and integral with the front and rear covers to a foredge of the one of the front and rear covers opposite the backbone edge which is initially greater than the corresponding width of the other of the front and rear covers;

applying a releasing adhesive to an inner surface of the one of the front and rear covers having the initially greater width;

folding an outer portion of the one of the front and rear covers having the initially greater width inwardly toward the backbone edge along a fold line so as to be in generally confronting relation with the inner surface of at least a portion of the remainder of the one of the front and rear covers to thereby cause the width after folding to generally correspond to the width of the other of the front and rear covers;

the signatures each having a width when measured from a backbone edge to a foredge which is initially less than the corresponding width of the one of the front and rear covers having the initially greater width prior to the step of folding the outer portion thereof;

the outer portion of the one of the front and rear covers having the initially greater width being folded along the fold line so as to place the releasing adhesive in adhesive contact with confronting surfaces of both the folded outer portion and the remainder of the one of the front and rear covers to adhesively secure them together after they have been folded into confronting relation;

affixing the cover to the body of the book with the backbone edge of the cover in confronting relation to the backbone edges of the signatures forming the body of the book;

the cover for the book comprising a soft cover that has the backbone edge secured to the backbone edges of the signatures by one of sewing, adhesive binding, saddlestich binding or mechanical binding; and trimming the book inwardly of at least the fold line of the one of the front and rear covers having the initially greater width and inwardly of the foredge of the other of the front and rear covers so as to form a finished foredge for the book while at the same time severing the folded outer portion from the remainder of the one of the front and rear covers having the initially greater width;

whereby the severed folded outer portion becomes an easily separable bookmark releasably secured by the releasing adhesive to the cover of the book.

7. The book making method of claim 6 wherein the trimming step includes trimming the signatures inwardly of the foredges while trimming the front and rear covers to form the finished foredge of the book such that the front and rear covers and the signatures are all of uniform width when measured from the backbone edges to the foredges thereof.

8. The book making method of claim 6 wherein the front and rear covers for the book are generally rectangular, the signatures forming the body of the book are also generally rectangular, and the bookmark formed during trimming when the folded outer portion of the one of the front and rear covers is severed is also generally rectangular.

9. The book making method of claim 6 wherein the one of the front and rear covers having the initially greater width comprises the rear cover of the book and wherein the severed folded outer portion comprising the bookmark is releasably secured in confronting relation to the inner surface of the rear cover by the releasing adhesive.

10. The book making method of claim 6 wherein the severed folded outer portion of the one of the front and rear covers having the initially greater width is less than one half the width of the remainder of the one of the front and rear covers after the book has been trimmed inwardly of the fold line and of the foredge of the other of the front and rear covers.

11. A method of making a book having a bookmark, comprising the steps of:

gathering a plurality of signatures on a collating conveyor in a predetermined order to thereby form a body of the book;

providing a cover for the book including a front cover and a rear cover wherein one of the front and rear covers has a width when measured from a backbone edge generally intermediate of and integral with the front and rear covers to a foredge of the one of the front and rear covers opposite the backbone edge which is initially greater than the corresponding width of the other of the front and rear covers;

applying a releasing adhesive to an inner surface of the one of the front and rear covers having the initially greater width;

folding an outer portion of the one of the front and rear covers having the initially greater width inwardly toward the backbone edge along a fold line so as to be in generally confronting relation with the inner surface of at least a portion of the remainder of the one of the front and rear covers to thereby cause the width after folding to generally correspond to the width of the other of the front and rear covers;

the signatures each having a width when measured from a backbone edge to a foredge which is initially less than the corresponding width of the one of the front and rear covers having the initially greater width prior to the step of folding the outer portion thereof;

the outer portion of the one of the front and rear covers having the initially greater width being folded along the fold line so as to place the releasing adhesive in adhesive contact with confronting surfaces of both the folded outer portion and the remainder of the one of the front and rear covers to adhesively secure them together after they have been folded into confronting relation;

affixing the cover to the body of the book with the backbone edge of the cover in confronting relation to the backbone edges of the signatures forming the body of the book;

the cover for the book comprising a soft cover that has the backbone edge secured to the backbone edges of the signatures by one of sewing, adhesive binding, saddlestich binding or mechanical binding; and trimming the book inwardly of at least the fold line of the one of the front and rear covers having the initially greater width and inwardly of the foredge of the other of the front and rear covers so as to form a finished foredge for the book while at the same time severing the folded outer portion from the remainder of the one of the front and rear covers having the initially greater width;

the trimming step including trimming the signatures inwardly of the foredges while trimming the front and rear covers to form the finished foredge of the book such that the front and rear covers and the signatures are all of uniform width when measured from the backbone edges to the foredges thereof;

whereby the severed folded outer portion becomes an easily separable bookmark releasably secured by the releasing adhesive to the cover of the book.

12. The book making method of claim 11 wherein the one of the front and rear covers having the initially greater width comprises the rear cover of the book and wherein the severed folded outer portion comprising the bookmark is releasably secured in confronting relation to the inner surface of the rear cover by the releasing adhesive.

13. The book making method of claim 12 wherein the severed folded outer portion of the one of the front and rear covers having the initially greater width is less than one half the width of the remainder of the one of the front and rear covers after the book has been trimmed inwardly of the fold line and of the foredge of the other of the front and rear covers.

14. The book making method of claim 13 wherein the releasing adhesive is fugitive glue that releasably secures the bookmark to the cover of the book and is easily removed from the bookmark and/or the inner surface of the rear cover of the book after the bookmark has been removed from the rear cover of the book for use thereof.

15. A book having a bookmark, comprising:

a body formed of a plurality of signatures in a predetermined order;

a cover affixed to the body of the book to define a front cover, a rear cover, and a backbone edge intermediate of and integral with the front cover and the rear cover;

the front cover and the rear cover each having a foredge opposite the backbone edge of the cover comprising finished free edges of the cover of the book;

a bookmark having a width less than one half of the width of the cover when measured from the backbone edge to the foredges of the front and rear covers;

the bookmark being formed of the same material as the cover and being releasably secured to an inner surface of one of the front and rear covers;

the bookmark having a finished free edge generally coincident with the finished free edge of the corresponding one of the front and rear covers; and a releasing adhesive between the inner surface of the corresponding one of the front and rear covers and a confronting surface of the bookmark.

16. The book of claim 15 wherein the bookmark is releasably secured in confronting relation to the inner surface of the rear cover by the releasing adhesive.

17. The book of claim 16 wherein the releasing adhesive is fugitive glue that releasably secures the bookmark to the inner surface of the rear cover of the book.

18. The book of claim 17 wherein the bookmark is formed by:

a) applying the fugitive glue to the inner surface of the rear cover;

b) folding an outer portion of the rear cover inwardly about a fold line;

c) bringing the folded outer portion into contact with the fugitive glue; and d) trimming the folded outer portion and rear cover inwardly of the fold line.

* * * * *